US005524581A

United States Patent [19]

Rush, II et al.

[11] Patent Number: 5,524,581

[45] Date of Patent: Jun. 11, 1996

[54] OUTBOARD MOTOR WITH IMPROVED ENGINE LUBRICATION SYSTEM

[75] Inventors: William B. Rush, II, Antioch; Gregory D. Irwin, Lindenhurst, both of Ill.; Jeffrey F. Wagner, Shreveport, La.; James C. Kantola, Waukegan, Ill.; Mark C. Noble, Pleasant Prairie, Wis.

[73] Assignee: Outboard Marine Corporation, Waukegan, Ill.

[21] Appl. No.: 318,382

[22] Filed: Oct. 5, 1994

[51] Int. Cl.[6] ..... F01M 9/10; F01M 1/06

[52] U.S. Cl. ..... 123/90.34; 123/196 R; 123/196 M; 123/196 W

[58] Field of Search ..... 123/90.33, 90.34, 123/90.38, 195 P, 196 R, 196 M, 196 W; 184/6.5, 6.18

[56] References Cited

U.S. PATENT DOCUMENTS 4,452,194 6/1984 Watanabe ..... 123/195
4,611,559 9/1986 Sumigawa ..... 123/196 W
5,090,375 2/1992 Hudson ..... 123/196 W
5,163,394 11/1992 Koishikawa et al. ..... 123/196 W

*Primary Examiner* Weilun Lo
*Attorney, Agent, or Firm* Michael, Best & Friedrich

[57] ABSTRACT

An internal combustion engine comprising a cylinder block which defines a cylinder, a crankshaft bearing supported at least in part by the cylinder block, a crankshaft which is rotatably supported by the crankshaft bearing, a piston slidably housed in the cylinder, a connecting rod having one end connected to the piston and having an opposite end connected to the crankshaft, a cylinder head mounted on the cylinder block, a camshaft at least partially supported by the cylinder head for rotation relative thereto, an oil pump having an outlet, a first oil conduit communicating between the oil pump outlet and the crankshaft bearing, an oil filter communicating with the first oil conduit for filtering oil only in the first oil conduit, and a second oil conduit communicating between the oil pump outlet and the camshaft, oil in the second oil conduit being unfiltered between the pump outlet and the camshaft.

18 Claims, 4 Drawing Sheets

OUTBOARD MOTOR WITH IMPROVED ENGINE LUBRICATION SYSTEM

BACKGROUND OF THE INVENTION

The invention relates to outboard motors, and more particularly to outboard motors with four-stroke engines. The invention also relates to lubrication systems for four-stroke engines.

It is known to lubricate a four-stroke engine of an outboard motor with oil from an oil sump or reservoir located in the driveshaft housing. It is also known to have an oil pump driven by the lower end of the camshaft, and to have the pump provide oil to the crankshaft bearings and the camshaft bearings via oil passageways in the cylinder header and cylinder block. It is also known to lubricate connecting rod journals with oil passages extending through the crankshaft from the crankshaft bearings to the connecting rod journals. See, for example, U.S. Pat. No. 4,452,194.

SUMMARY OF THE INVENTION

The invention provides an improved pressurized lubrication system for an outboard motor with a four-stroke engine. More particularly, the invention provides an oil reservoir, preferably in the driveshaft housing, and an oil pump which is mounted on the bottom of the cylinder head and which is driven by the camshaft. Oil flows from the reservoir to the pump through an oil passageway in the cylinder block and in the cylinder head. Oil flow splits at the pump outlet.

A portion of the oil from the pump outlet flows directly into the cylinder head where it lubricates the camshaft bearings and the valve train mechanism. An oil passageway in the cylinder head terminates adjacent the upper camshaft bearing surface. The outer surface of the camshaft has therein a groove which extends generally vertically along the camshaft from the upper camshaft bearing surface to a point below the upper camshaft bearing surface. When the groove is aligned with the end of the oil passageway, such alignment occurring once every rotation of the camshaft, oil flows into the groove and downwardly along the camshaft so as to lubricate both the camshaft and the valve train mechanism.

Another portion of the oil from the pump outlet flows through the cylinder head and the cylinder block to an oil filter mounted on the side of the cylinder block. After flowing through the oil filter, the oil flows through the cylinder block to an oil gallery that feeds oil to the upper and lower crankshaft main bearings. The crankshaft has therein oil passages communicating between the main bearings and the connecting rod bearing surfaces for lubricating the connecting rod bearing surfaces.

All oil flowing to the crankshaft main bearings and the connecting rod bearing surfaces is filtered downstream of the pump, while all oil flowing to the camshaft is unfiltered. The lubrication system preferably includes an oil pressure regulator valve which is mounted on the bottom of the cylinder block and which communicates with the oil passageway between the pump outlet and the filter. The valve limits oil pressure in the system to a maximum predetermined level. When oil pressure is below this level, oil flows past the valve to the filter. When oil pressure is above this level, the valve opens and allows oil flow through the valve to the reservoir.

Other features and advantages of the invention will become apparent to those skilled in the art upon review of the following detailed description, claims and drawings.

Figure 1:
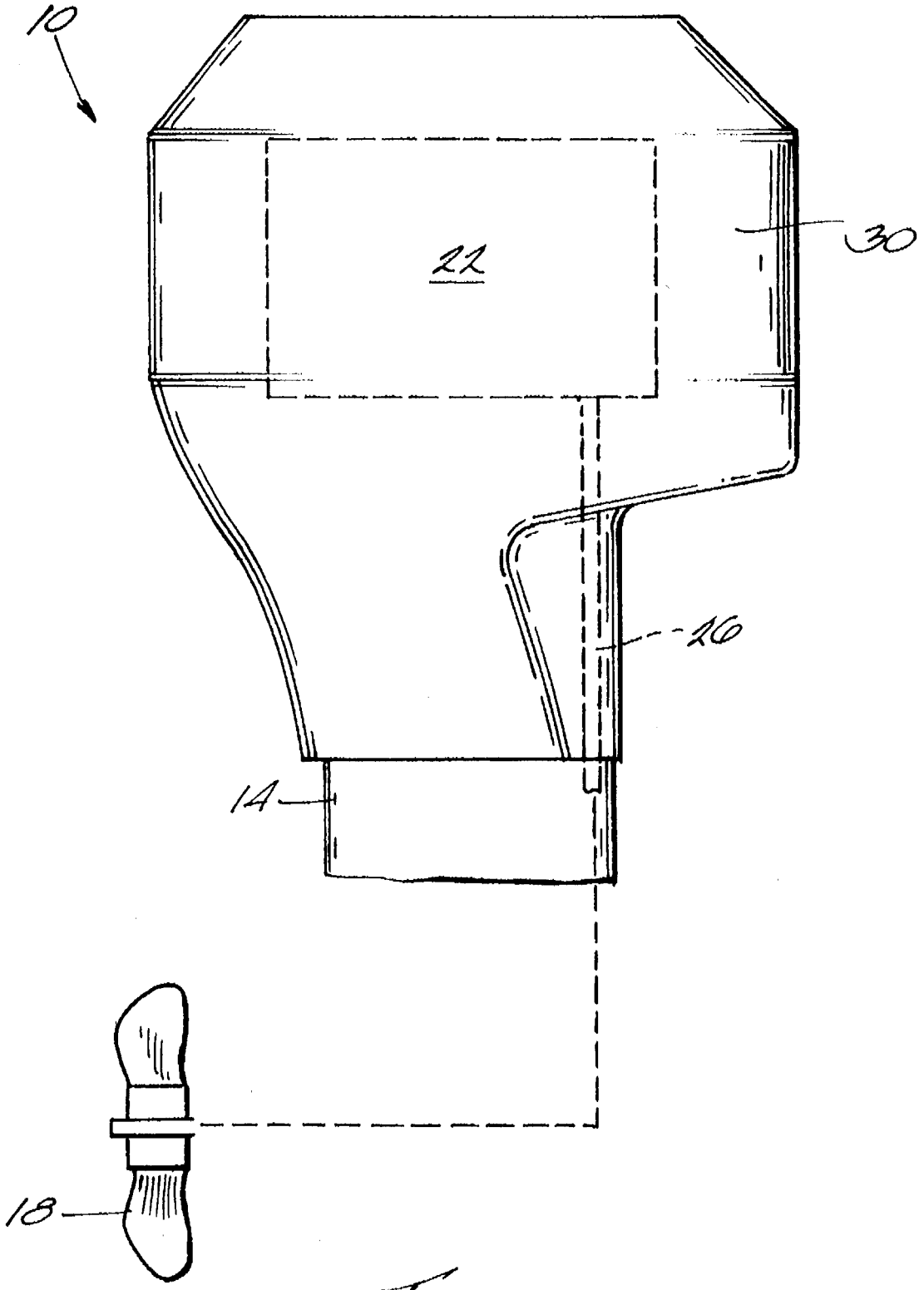
FIG. 1 is a partial side elevational view of an outboard motor embodying the invention.

Before one embodiment of the invention is explained in detail, it is to be understood that the invention is not limited in its application to the details of the construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF THE PREFERRED EMBODIMENT

An outboard motor 10 embodying the invention is partially illustrated in FIG. 1. The outboard comprises a driveshaft housing 14 (partially shown), a propeller 18 rotatably supported by the driveshaft housing 14, and a four-stroke internal combustion engine 22 which is mounted on the driveshaft housing 14 and which is drivingly connected to the propeller 18 via a conventional drive train 26. A cover or shroud 30 is mounted on the driveshaft housing 14 and surrounds the engine 22.

Figure 3:
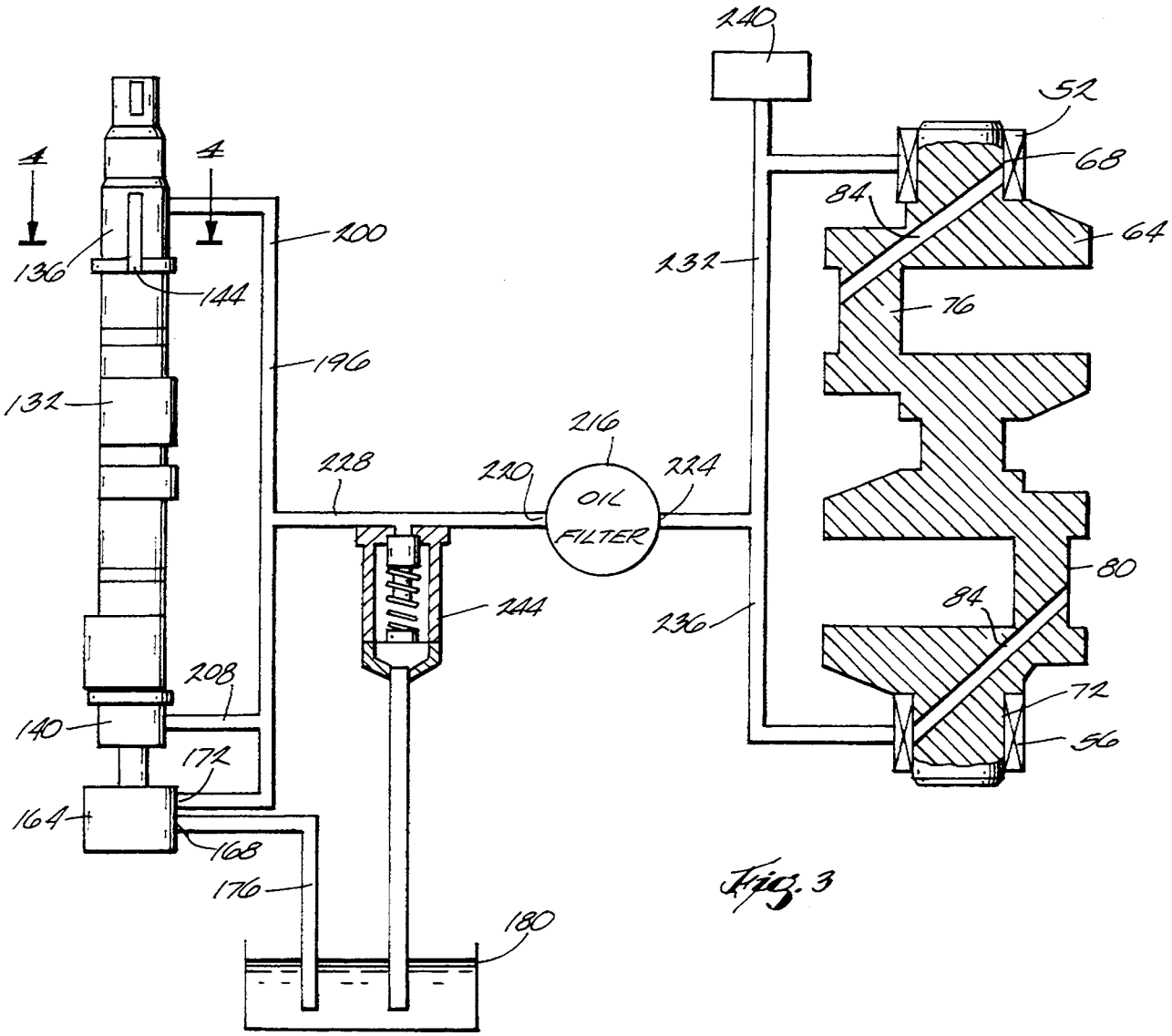
FIG. 3 is a schematic view of the lubrication system.

The engine 22 includes (see FIG. 2) a cylinder block 34 supported by the upper end of the driveshaft housing 14. The cylinder block 34 has a bottom surface 38 and defines upper and lower cylinders 42 and 46. Upper and lower crankshaft bearings 52 and 56 are sandwiched between the cylinder block 34 and a crankcase cover 60 mounted on the cylinder block 34. A crankshaft 64 is rotatably supported by the crankshaft bearings 52 and 56 and is drivingly connected to the propeller 18 by the drive train 26. The crankshaft 64 includes an upper crankshaft bearing surface 68 engaging the upper crankshaft bearing 52, and a lower crankshaft bearing surface 72 engaging the lower crankshaft bearing 56. The crankshaft 64 also includes (see FIG. 3) upper and lower connecting rod bearing surfaces 76 and 80. An upper oil passageway 84 extends from the upper crankshaft bearing surface 68 to the upper connecting rod bearing surface 76, and a lower oil passageway 88 extends from the lower crankshaft bearing surface 72 to the lower connecting rod bearing surface 80.

An upper piston 100 is slidably housed in the upper cylinder 42, and an upper connecting rod 104 has one end connected to the piston 100 and has an opposite end connected to the crankshaft 64 at the upper connecting rod bearing surface 76. A lower piston (not shown) is slidably housed in the lower cylinder 46, and a lower connecting rod (not shown) has one end connected to the lower piston and has an opposite end connected to the crankshaft 64 at the lower connecting rod bearing surface 80.

The engine 22 also includes (see FIG. 2) a cylinder head 116 which is mounted on the cylinder block 34 and which has a bottom surface 120. The cylinder head 116 includes upper and lower bearing surfaces 124 and 128. A camshaft 132 is supported by the cylinder head 116 for rotation relative thereto. The camshaft 132 has upper and lower ends and an outer surface including upper and lower camshaft bearing surfaces 136 and 140 respectively engaging the upper and lower cylinder head bearing surfaces 124 and 128. The outer surface of the camshaft 132 has therein (see FIGS. 2 and 4) a groove 144 which extends generally vertically from the upper camshaft bearing surface 136 to a point below the upper camshaft bearing surface 136. The engine 22 also includes (see FIG. 2) a rocker arm shaft 152 which is pivotally supported by the cylinder head 116 and which has thereon rocker arms 156 that operate in a known manner to open inlet and exhaust valves. One valve 160 is illustrated in FIG. 2.

Figures 2, 4:
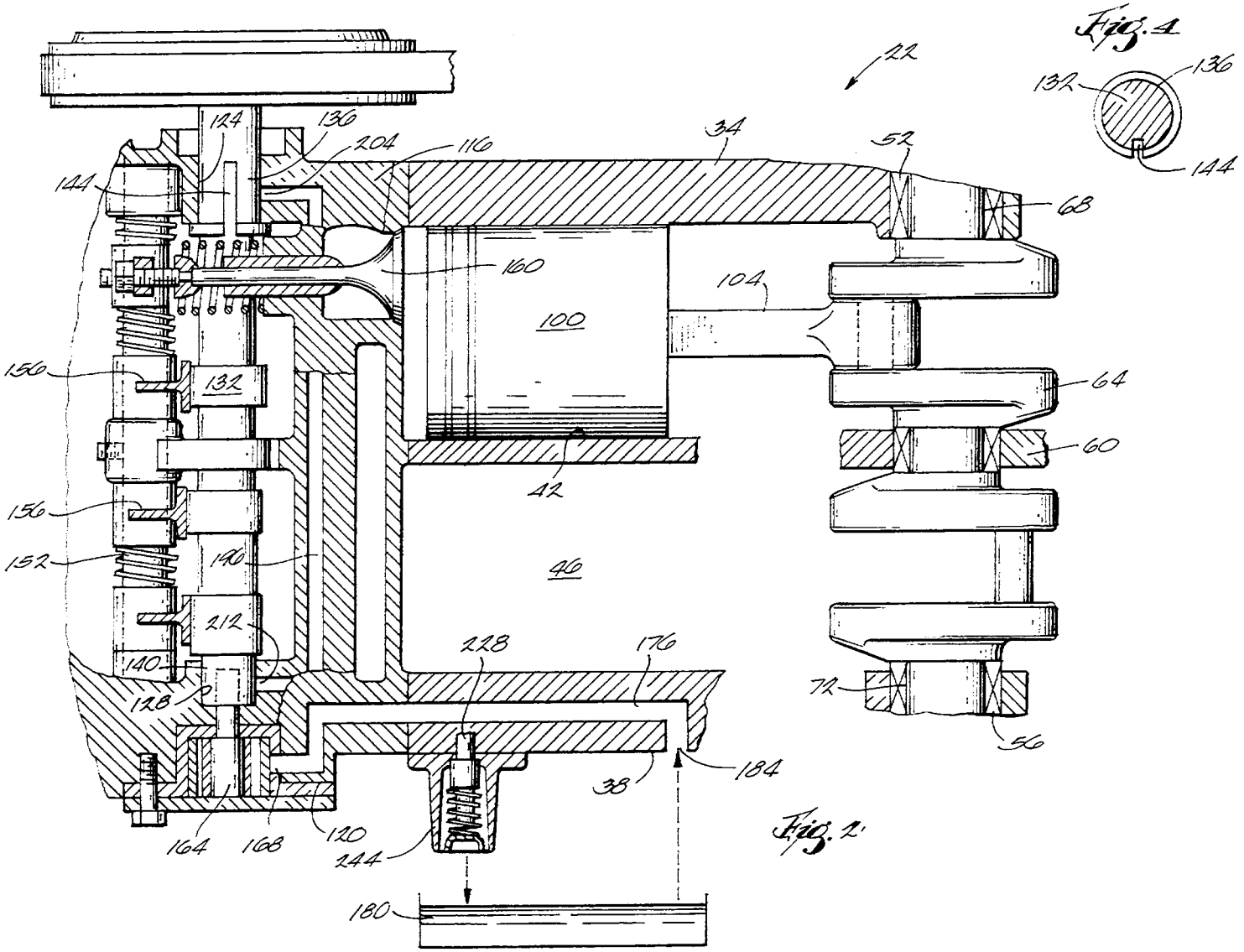
FIG. 2 is a partial sectional view of the engine.
FIG. 4 is a view taken along line 4 4 in FIG. 3.
Figure 5:
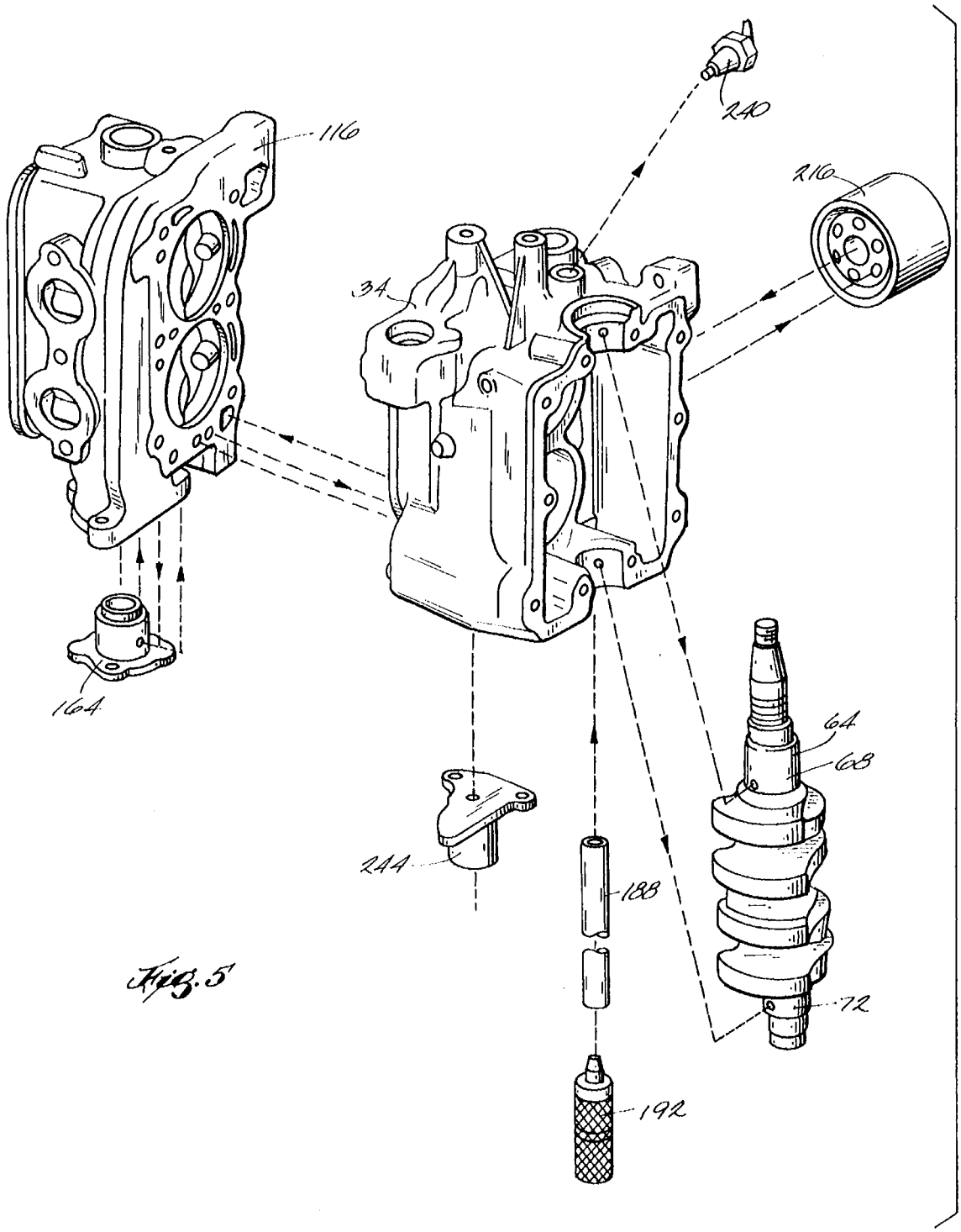
FIG. 5 is a partial exploded, perspective view of the engine showing oil flow therethrough.

As shown in FIG. 2, an oil pump 164 is mounted on the bottom surface of the cylinder head 116 and is driven by the lower end of the camshaft 132. The pump 164 has an inlet 168 (see FIGS. 2 and 3) and an outlet 172 (see FIG. 3). A first oil conduit 176 (see FIGS. 2 and 3) communicates between an oil reservoir 180 and the pump inlet 168. The oil reservoir 180 is preferably located in the driveshaft housing 14 and can be formed in any suitable manner. The oil conduit 176 is defined in part by the cylinder block 34 and in part by the cylinder head 116. The oil conduit 176 has (see FIG. 2) an inlet end 184 at the bottom surface of the cylinder block 34. Oil flows from the oil reservoir 180 to the inlet end 184 of the conduit 176 through an oil pipe 188 (see FIG. 5) having thereon a filter 192.

A second oil conduit 196 (see FIGS. 2 and 3) communicates between the pump outlet 172 and the camshaft bearing surfaces 136 and 140. The conduit 196 is defined entirely by the cylinder head 116. The conduit 196 has (see FIGS. 2 and 3) an upper branch 200 terminating at an opening 204 (see FIG. 2) in the upper cylinder head bearing surface 124. The conduit 196 has (see FIG. 3) a lower branch 208 terminating at an opening 212 (see FIG. 2) in the lower cylinder head bearing surface 128. Oil flowing through the upper branch 200 lubricates the upper camshaft bearing surface 136, and oil flowing through the lower branch 208 lubricates the lower camshaft bearing surface 140. When the groove 144 in the camshaft 132 is aligned with the opening 204 in the upper cylinder head bearing surface 124, oil flows into the groove 144 and then downwardly along the camshaft 132 to lubricate both the camshaft 132 and the valve train mechanism.

An oil filter 216 (see FIGS. 3 and 5) is mounted on the side of the cylinder block 34 and has (see FIG. 3) an inlet 220 and an outlet 224. A third oil conduit 228 (see FIG. 3) communicates with the pump outlet 172 and is defined in part by the cylinder head 116 and in part by the cylinder block 34. From the pump outlet 172, the conduit 228 extends through the cylinder head 116 and the cylinder block 34 to the filter inlet 220. From the filter outlet 224, the conduit 228 divides into an upper branch 232 communicating with the upper crankshaft bearing 52 and a lower branch 236 communicating with the lower crankshaft bearing 56. Oil from the upper crankshaft bearing 52 flows through the upper oil passageway 84 in the crankshaft 64 to lubricate the upper connecting rod bearing surface 76. Oil from the lower crankshaft bearing 56 flows through the lower oil passageway 88 in the crankshaft 64 to lubricate the lower connecting rod bearing surface 80. The upper branch 232 also communicates with an oil pressure switch 240 which is conventional and which activates an alarm or warning device (not shown) in the event of low oil pressure.

An oil pressure regulator valve 244 (see FIGS. 2, 3 and 5) is mounted on the bottom surface of the cylinder block 34 and communicates with the conduit 228 upstream of the filter 216. The valve 244 is normally closed but opens to allow oil flow from the conduit 228 to the oil reservoir 180 when the pressure in the conduit 228 is greater than a predetermined value.

Various features of the invention are set forth in the following claims.

We claim:

1. An internal combustion engine comprising a cylinder block which defines a cylinder, a crankshaft supported at least in part by said cylinder block, a piston slidably housed in said cylinder, a connecting rod having one end connected to said piston and having an opposite end connected to said crankshaft, a cylinder head mounted on said cylinder block, a camshaft at least partially supported by said cylinder head for rotation relative thereto, having an outer surface including a camshaft bearing surface having therein a groove which extends from said camshaft bearing surface to a point spaced from said camshaft bearing surface, and an oil conduit communicating between said oil pump outlet and said camshaft bearing surface such that said groove in said camshaft moves into and out of alignment with said oil conduit during each rotation of said camshaft, such that said groove receives oil from said oil conduit when said groove is aligned with said oil conduit, and such that said groove conducts oil received from said oil conduit along said camshaft to lubricate portions of said camshaft spaced from said camshaft bearing surface point.

2. An internal combustion engine as set forth in claim 1 wherein said oil conduit is defined in part by said cylinder head.

3. An internal combustion engine as set forth in claim 1 wherein said camshaft has a second bearing surface, and wherein said oil conduit also communicates with said second camshaft bearing surface.

4. An internal combustion engine comprising a cylinder block which defines a cylinder, a crankshaft bearing supported at least in part by said cylinder block, a crankshaft which is rotatably supported by said crankshaft bearing, a piston slidably housed in said cylinder, a connecting rod having one end connected to said piston and having an opposite end connected to said crankshaft, a cylinder head mounted on said cylinder block, a camshaft at least partially supported by said cylinder head for rotation relative thereto, an oil pump having an outlet, a first oil conduit communicating between said oil pump outlet and said crankshaft bearing, an oil filter communicating with said first oil conduit for filtering oil only in said first oil conduit, and a second oil conduit communicating between said oil pump outlet and said camshaft, oil in said second oil conduit being unfiltered between said pump outlet and said camshaft.

5. An internal combustion engine as set forth in claim 4 wherein said first oil conduit is defined in part by said cylinder block.

6. An internal combustion engine as set forth in claim 5 wherein said first oil conduit is also defined in part by said cylinder head.

7. An internal combustion engine as set forth in claim 4 wherein said second oil conduit is defined in part by said cylinder head.

8. An internal combustion engine as set forth in claim 4 wherein said internal combustion engine comprises upper and lower crankshaft bearings which are supported at least in part by said cylinder block and which support said crankshaft, and wherein said first oil conduit communicates with both of said upper and lower crankshaft bearings.

9. An internal combustion engine as set forth in claim 4 wherein said camshaft has spaced bearing surfaces, and wherein said second oil conduit communicates with both of said camshaft bearing surfaces.

10. An internal combustion engine as set forth in claim 4 wherein said oil filter is mounted on said cylinder block.

11. An outboard motor comprising a driveshaft housing, a propeller rotatably supported by said driveshaft housing, an oil reservoir, and an internal combustion engine including a cylinder block which is supported by said driveshaft housing, which has a bottom surface, and which defines a cylinder, a crankshaft bearing supported at least in part by said cylinder block, a crankshaft which is rotatably supported by said crankshaft bearing and which is drivingly connected to said propeller, said crankshaft including a crankshaft bearing surface engaging said crankshaft bearing, said crankshaft also including a connecting rod bearing surface, and said crankshaft having therein an oil passageway extending from said crankshaft bearing surface to said connecting rod bearing surface, a piston slidably housed in said cylinder, a connecting rod having one end connected to said piston and having an opposite end connected to said crankshaft at said connecting rod bearing surface, a cylinder head mounted on said cylinder block, said cylinder head having a bottom surface, a camshaft at least partially supported by said cylinder head for rotation relative thereto, said camshaft having a lower end and an outer surface including upper and lower camshaft bearing surfaces, said outer surface having therein a groove which extends from said upper camshaft bearing surface to a point below said upper camshaft bearing surface, an oil pump which is mounted on said bottom surface of said cylinder head and which is driven by said lower end of said camshaft, said oil pump having an inlet and an outlet, a first oil conduit communicating between said oil reservoir and said oil pump inlet, a second oil conduit communicating between said oil pump outlet and said crankshaft bearing, a third oil conduit communicating between said oil pump outlet and said camshaft upper bearing surface, such that said groove in said camshaft moves into and out of alignment with said third oil conduit during each rotation of said camshaft, such that said groove receives oil from said third oil conduit when said groove is aligned with said third oil conduit, and such that said groove conducts oil received from said third oil conduit along said camshaft to lubricate portions of said camshaft below said upper camshaft bearing surface, an oil filter communicating with said second oil conduit for filtering oil only in said second oil conduit, said oil filter being the only oil filter communicating with said second and third oil conduits, and an oil pressure regulator valve mounted on said bottom surface of said cylinder block, said valve communicating with said second oil conduit upstream of said oil filter, said valve also communicating with said oil reservoir and allowing oil flow from said second oil conduit to said oil reservoir when the oil pressure in said second oil conduit is greater than a predetermined value.

12. An outboard motor as set forth in claim 11 wherein said second oil conduit is defined in part by said cylinder block.

13. An outboard motor as set forth in claim 12 wherein said second oil conduit is also defined in part by said cylinder head.

14. An outboard motor as set forth in claim 11 wherein said third oil conduit is defined in part by said cylinder head.

15. An outboard motor as set forth in claim 11 wherein said outboard motor comprises upper and lower crankshaft bearings supported at least in part by said cylinder block, wherein said crankshaft includes upper and lower crankshaft bearing surfaces respectively engaging said upper and lower crankshaft bearings, and wherein said second oil conduit communicates with both of said upper and lower crankshaft bearings.

16. An outboard motor as set forth in claim 15 wherein said oil passageway extends from said upper crankshaft bearing surface to said connecting rod bearing surface, wherein said crankshaft includes a second connecting rod bearing surface, and wherein said crankshaft has therein a second oil passageway extending from said lower crankshaft bearing surface to said second connecting rod bearing surface.

17. An outboard motor as set forth in claim 11 wherein said third oil conduit also communicates with said camshaft lower bearing surface.

18. An outboard motor as set forth in claim 11 wherein said oil filter is mounted on said cylinder block.

* * * * *